United States Patent [19]

Platek

[11] 3,939,515

[45] Feb. 24, 1976

[54] DUAL PURPOSE CLEANING APPARATUS

[76] Inventor: Stanley F. Platek, 187 Maplewood Ave., Maplewood, N.J. 07040

[22] Filed: Feb. 10, 1975

[21] Appl. No.: 548,405

Related U.S. Application Data

[63] Continuation-in-part of Ser. No. 444,781, Feb. 22, 1974, abandoned.

[52] U.S. Cl. ..... 15/321; 15/328; 15/347; 15/352

[51] Int. Cl.[2] ..... A47L 11/20

[58] Field of Search ..... 15/320, 321, 328, 330, 15/334, 347, 350, 351, 352

[56] References Cited

UNITED STATES PATENTS

| | | | |
|---|---|---|---|
| 1,764,439 | 6/1930 | Fuhrmann | 15/328 |
| 2,198,322 | 4/1940 | Von Schrader | 15/321 X |
| 2,449,876 | 3/1950 | Platek | 15/330 |
| 2,718,655 | 9/1955 | Cymara | 15/334 X |
| 3,606,631 | 9/1971 | Vassh et al. | 15/321 |
| 3,755,850 | 9/1973 | Porter | 15/320 |

*Primary Examiner*—Stanley N. Gilreath
*Assistant Examiner*—C. K. Moore
*Attorney, Agent, or Firm*—Anthony F. Cuoco

[57] ABSTRACT

Improved apparatus for cleaning upholstery, carpets, rugs and the like by either shampooing or dry vacuuming includes baffle means arranged for selectively conditioning the apparatus for either operation without changing existing connections so that the conditioning is performed quickly and efficiently to enhance the selected cleaning operation.

10 Claims, 8 Drawing Figures

DUAL PURPOSE CLEANING APPARATUS

CROSS REFERENCE TO RELATED PATENTS AND APPLICATIONS

This invention is an improvement over the device described in U.S. Pat. No. 2,499,876 issued on Mar. 7, 1950 to Stanley F. Platek, the inventor of the present invention. This application is a Continuation-In-Part of U.S. application Ser. No. 444,781 filed on Feb. 22, 1974 by Stanley F. Platek, and now abandoned.

BACKGROUND OF THE INVENTION

1. Field of the Invention

This invention relates to apparatus for shampooing, vacuuming or similar cleaning of upholstery, rugs, carpets and the like and particularly, to novel means for quickly efficiently and selectively conditioning the apparatus for performing one or the other of the cleaning operations.

2. Description of the Prior Art

The cleaning apparatus described in the aforenoted U.S. Pat. No. 2,499,876 includes a main container and a second container mounted within the main container and adapted to hold a detergent solution. An electrically operated blower fan is arranged with its intake or suction port in communication with the interior of the main container. The discharge port of the blower fan is disconnectably coupled to the interior of the second container so as to pass forced air through said container and the liquid detergent contained therein for providing a foaming, lather or sudsing effect, and for delivering the suds from the second container through a discharge nozzle to means for applying the suds to the article to be cleaned. The main container includes an inlet nozzle to which a suction means may be coupled. After application of the suds to the article to be cleaned has been satisfactorily accomplished, the applied suds are removed from the article by conditioning the apparatus for such suds removal. This is accomplished by disconnecting the second container from the blower fan for preventing air from being forced through the detergent, whereupon operation of the blower fan sucks air through the suction means to the main container for taking up the lather, foam or suds. When dry vacuuming is desired a collection bag is coupled to the discharge port of the blower fan to collect dust and/or dirt. It will thus be seen that when it is desired to shift from one cleaning operation to another it is necessary to change the existing connections to effectively condition the apparatus for the desired operation. This is time consuming and leads to a discontinuity in the cleaning operation; that is, it does not permit rapid, sequential shampooing and suds removal and/or vacuuming and shampooing as the case may be. Efficient cleaning of upholstery, rugs and carpeting requires this continuity, and quick changeover from one clean operation to the other is a necessary feature is achieving same.

SUMMARY OF THE INVENTION

This invention contemplates improved dual purpose cleaning apparatus including a main container and a second container mounted within the main container and adapted to hold a detergent solution. An electrically operated blower fan is arranged with its intake port in communication with the interior of the main container and its discharge port is coupled through a conduit to the interior of the second container.

In one embodiment of the invention an operator-operable baffle means is arranged with the conduit and is operated to a first selected position for permitting air to be forced through the conduit to the second container and its contained detergent solution for providing a sudsing, foam or lather effect, whereupon the suds are delivered from a discharge conduit of the second container through an applying means to the article to be cleaned. The baffle means is operated to a second position for blocking the flow of air to the second container, whereupon air is drawn into the first container through an inlet nozzle to provide a suction or vacuuming effect for suds removal, with the soiled suds thereupon being collected in the main container. The apparatus may be used for a dry vacuum cleaning operation with the baffle means in the second position as aforenoted, a suitable vacuum attachment connected to the inlet nozzle and a collection bag connected to the baffle means to collect dust and/or dirt as the case may be.

In another embodiment of the invention the baffle means is arranged with the discharge conduit of the second container and is selectively operator-operable to a first or open position whereupon air is forced through the conduit to the second container and suds are delivered from the discharge conduit of the second container through the applying means as aforenoted. The baffle means is operated to a second or closed position whereupon the flow of suds is blocked and air backs up in the conduit and flows to the collection bag for actuating valve means supported therein to provide the suction or vacuuming effect for suds removal or for providing the dry vacuum cleaning affect as aforenoted.

The main object of this invention is to provide cleaning apparatus of the type described which may be quickly, efficiently and selectively conditioned for performing either shampooing or vacuum cleaning operations on rugs, carpets, upholstery and the like.

Another object of this invention is to accomplish the above by providing operator-operable selectively positioned baffle means for conditioning the cleaning apparatus for either of the cleaning operations.

Another object of this invention is to provide cleaning apparatus of the type described wherein the need for changing existing connections to condition the apparatus for the selected cleaning operation is eliminated.

The foregoing and other objects and advantages of the invention will appear more fully hereinafter from a consideration of the detailed description which follows taken together with the accompanying drawings wherein several embodiments of the invention are illustrated by way of example. It is to be expressly understood, however, that the drawings are for illustration purposes only and are not to be construed as defining the limits of the invention, reference being had to the appended claims for that purpose.

DESCRIPTION OF THE INVENTION

Figure 1:
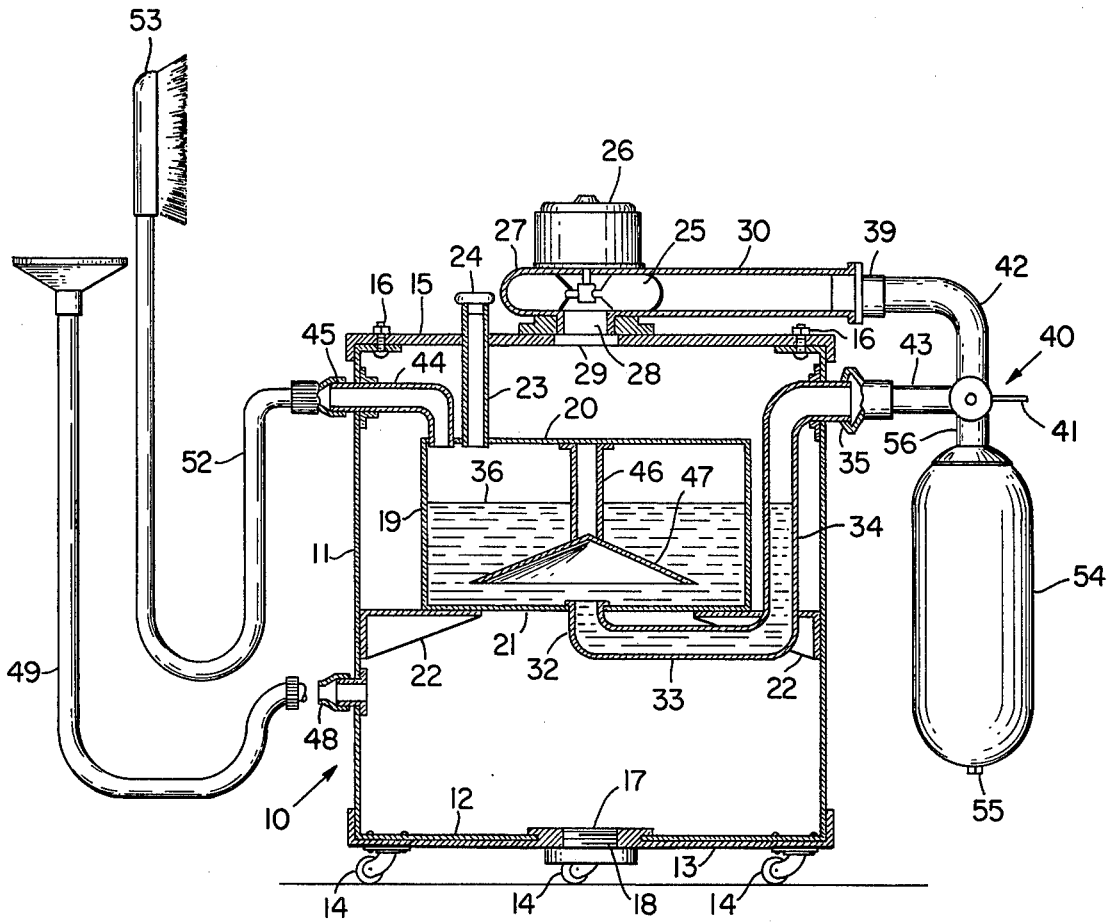
FIG. 1 is a vertical cross section taken through the center of the cleaning apparatus according to one embodiment of the invention.
Figure 2:
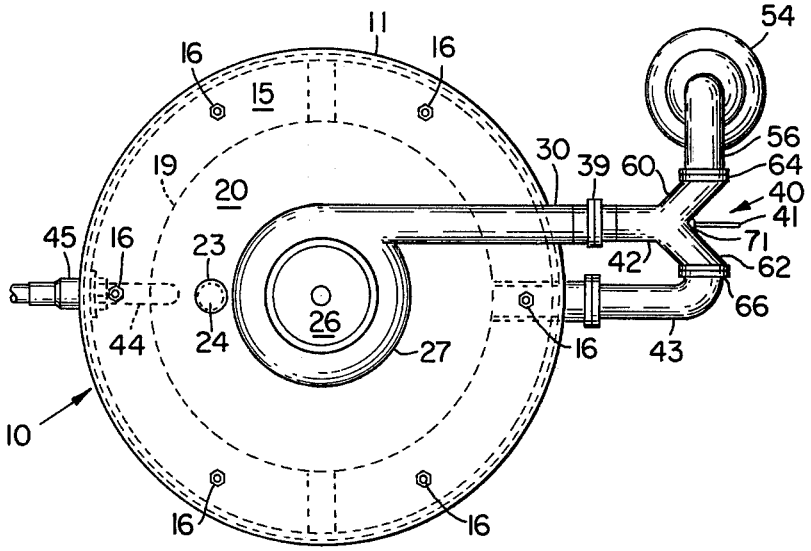
FIG. 2 is a top plan view of the cleaning apparatus shown in FIG. 1.

With reference to FIG. 1 and 2 wherein one embodiment of the invention is shown, the improved cleaning apparatus according to the invention is designated by the numeral 10 and includes a main container 11 having a bottom wall 12 supported by and suitably affixed to a carriage 13. Carriage 13 carries casters 14 so that the cleaning apparatus is rendered mobile for being conveniently moved from place to place as is desired in cleaning rugs, carpets, furniture, upholstery and the like. Main container 11 has an open top which normally is closed by a cover 15, and which cover 15 is removably affixed to the main container by fastening bolt and nut means 16, or some other such suitable fastening means. Main container 11 may be of any suitable shape, but is preferably cylindrical as shown in the drawing. Bottom wall 12 of container 11 has a clean-out opening 17 which is normally closed by a removable plug 18.

A second container 19 is supported within the interior of main container 11 intermediate the top and bottom of the main container, and which second container is closed by a top wall 20 and a bottom wall 21. Container 19 is smaller in diameter than container 11 and is mounted within the latter in concentric relation thereto being supported by brackets 22 which extend from the side walls of main container 11, or by some other such suitable supporting means. Container 19 has a filling neck 23 extending from its top wall 20, and which neck 23 extends through cover 15 of container 11. Filling neck 23 has an open end which is normally closed by a removable plug 24.

A blower fan 25 and its actuating electric motor 26 are suitably mounted in fixed relation to cover 15 of main container 11. The casing or housing 27 of the blower fan is provided with an axial air intake port 28 which communicates with the interior of main container 11 through an opening 29 in cover 15 with which the intake port 28 is aligned. Housing 27 is further provided with an outlet or discharge member 30 which extends outwardly therefrom.

An air delivery conduit 33 extends within main container 11 and has a discharge end portion 32 which is connected with bottom wall 21 of container 19 so as to discharge into the interior thereof. Air delivery conduit 33 extends nearly to the side wall of main container 11 and terminates in an internal intake portion 34 having an inlet port 35 disposed external to the main container and in a plane above the level of a liquid detergent solution 36 carried within the interior of container 19. A conduit 39 leads from discharge member 30 to a conduit 42 which leads to a baffle means 40. Baffle means 40 is operator-operated through a handle or arm 41. Inlet port 35 is connected to baffle means 40 through a conduit 43.

Leading outwardly from the top of container 19 is a discharge conduit 44 which extends to and through the side wall of container 11 and terminates in a discharge nozzle or spout 45 which projects exterior to container 11.

Suspended within the interior of container 19 is a suitable supporting means such as a hanger 46 so as to overhang the discharge end 32 of air delivery conduit 33. In suitable spaced relation to and above the latter is an air deflector 47. Deflector 47 is preferably in the form of a hollow cone, the open bottom of which opposes the discharge end 32 of air delivery conduit 33.

Prior to using the cleaning apparatus now being described, liquid detergent solution 36 is supplied to container 19 through filling neck 23 in quantities sufficient to submerge air deflector 47 but yet only partially filling container 19 so as to leave open space above the fluid level within the interior of the container.

When using the cleaning apparatus to perform a cleaning operation by shampooing or the like, baffle means 40 is operator-operated through arm 41 to a first selected position as will be hereinafter described, whereby conduit 42 connected to discharge member 30 of blower fan through conduit 39 is in communication with conduit 43 leading to air delivery conduit 33 through port 35 and intake portion 34. Electric current is thereupon supplied to motor 26 so as to operate blower fan 25.

An air inlet port 48 in the side wall of container 11 is open to the atmosphere. Operation of the blower fan sucks air from the atmosphere through nozzle 48 into main container 11 and thereupon through inlet port 29 and blower fan intake 28. The blower fan discharges air through its discharge member 30 and through conduits 42 and 43 to air delivery conduit 33 via inlet port 35 and intake portion 34 for discharge into and through liquid detergent solution 36 within container 19. The stream of air thus forced into container 19 will be deflected by air deflector 47 so as to be directed outwardly from the rim thereof to pass into the solution. The air is substantially uniformly distributed laterally through the solution and in all directions to thereupon bubble upwardly therethrough for agitating and aerating the solution to produce lather, foam or suds for accumulation within the upper interior portion of container 19 above the level of solution 36 therein. The continued flow of forced air through discharge conduit 44 and nozzle 45 delivers suds to a suitable cleaning attachment 52 having a brush 53 or the like connected thereto, whereby lather, foam or suds will be discharged for application to the article to be cleaned.

After application of lather, foam or suds to the article to be cleaned has been satisfactorily accomplished, the applied lather, foam or suds, together with the dirt taken up thereby, may be removed from the article under treatment by operator adjustment of baffle arrangement 40 through handle 41 to a second selected position whereby the flow of air through conduit 33 to the interior of container 19 is blocked and a vacuum or suction is drawn in a manner as will be next described.

With the flow of air thus blocked and the blower fan again put into operation, air will be sucked through a suitable vacuum or suction attachment 49 terminating in an air scoop or the like and coupled to inlet port 48, into the interior of main container 11. The air suction thus induced will take up the soiled lather, foam or suds from the article being cleaned and will carry the same into the interior of main container 11 where it will fall out of the air stream so as to accumulate in the bottom of the container which may be subsequently emptied of accumulated soiled lather, foam or suds through the removal of closure plug 18 from bottom opening 17 in the container. It will be understood that the interior of the main container may be thoroughly cleaned by removing the cover member 15 for access thereto.

When it is desired to operate the cleaning apparatus in a dry vacuum method, baffle arrangement 40 is again actuated to the second selected position as described above, except that a dust collection bag 54 having a clean out plug or stopper 55 is connected to baffle 40 through a conduit 56 as will be hereinafter described for collecting accumulated dust and dirt through attachment 49 as will now be understood.

Figure 3:
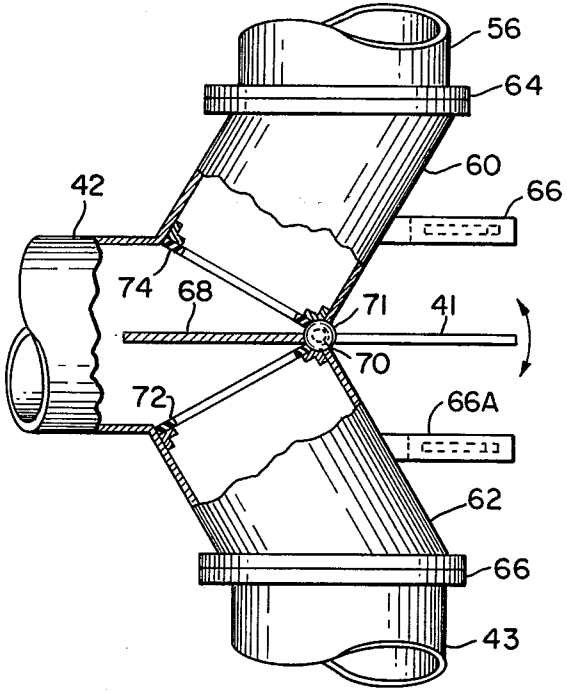
FIG. 3 is a diagrammatic, partially sectioned top view of a baffle arrangement according to the embodiment of the invention shown in FIG. 1.

Reference is now made to FIGS. 2 and 3 wherein baffle means 40 is shown as including a substantially V-shaped adapter having a vacuum member 60 and a foam member 62. Vacuum member 60 is coupled to conduit 56 through suitable coupling means 64 and foam member 62 is coupled to conduit 43 through suitable coupling means 66. Members 60 and 62 lead into and are integral with conduit 42.

As shown in FIGS. 3–6 a baffle plate 68 is disposed within baffle means 40 and is suitably secured to baffle arm 41. Baffle plate 68 and baffle arm 41 are arranged to pivot about a baffle pin 70 arranged in a sealed housing 71. When arm 41 is operator actuated in a counterclockwise direction as shown by the arrow in FIG. 3 to condition the apparatus for vacuuming, baffle plate 68 closes the opening between foam member 62 and conduit 42 so as to block the passage of air from blower motor 26 to container 19. When arm 41 is operated actuated in a clockwise direction to condition the apparatus for shampooing, baffle plate 68 closes the opening between vacuum member 60 and conduit 42 to prvent suction of air therethrough from inlet port 48 and the interior of container 11.

Figure 6:
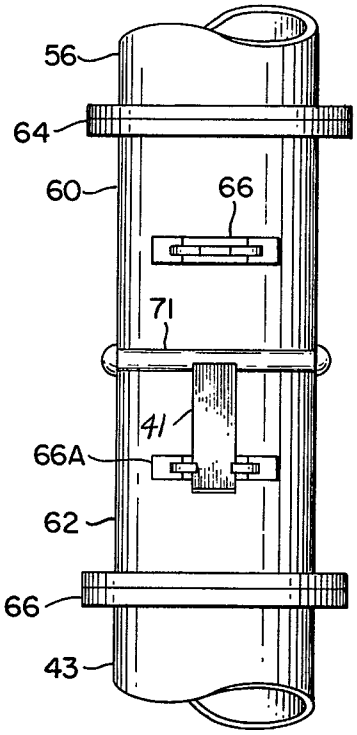
FIG. 6 is a diagrammatic right end view, relative to FIG. 3, best showing a baffle arm locking feature of the invention according to the embodiment of the invention of FIG. 1.
Figure 4:
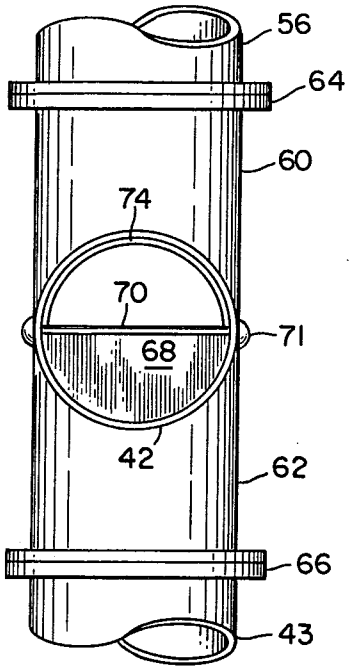
FIG. 4 is a diagrammatic left end view, relative to FIG. 3, showing the baffle arrangement of FIG. 3, wherein a baffle plate is disposed in a first selected position.
Figure 5:
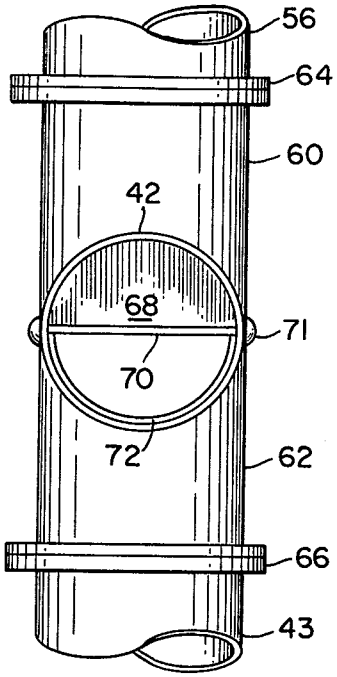
FIG. 5 is a diagrammatic left end view, relative to FIG. 3, showing the baffle arrangement wherein the baffle plate of FIG. 4 is disposed in a second selected position.

As best shown in FIGS. 3 and 4, when arm 41 is actuated in a counterclockwise direction to close foam portion 62, baffle plate 68 is adjacent a resilient sealing washer or gasket 72 suitably secured in the entry of foam portion 62 and arm 41 is locked in position by a clamp 66 which may be a generally U-shaped spring type clamp well known in the art for retaining arm 41 in position to maintain the foam closure. As best shown in FIGS. 3 and 5, when arm 41 is actuated in a clockwise direction to close vacuum portion 60, plate 68 is adjacent a resilient sealing washer or gasket 74 suitably secured in the entry of vacuum portion 60 and arm 41 is clocked in position by a similar spring clamp 66A as shown in FIG. 6.

Figure 8:
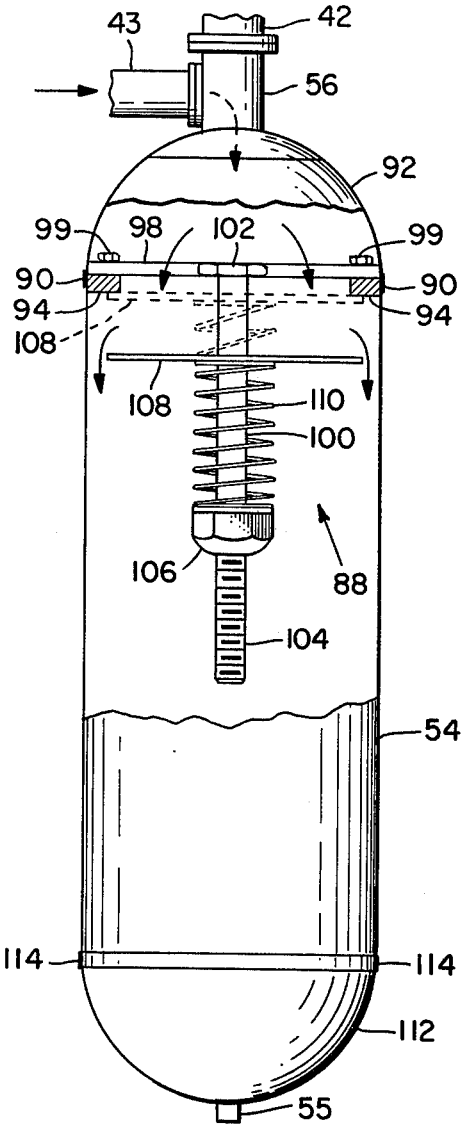
FIG. 8 is a diagrammatic representation showing valve means supported within a collection bag and operable upon the baffle means of FIG. 7 being selectively operated to a closed position for providing a vacuuming effect.
Figure 7:
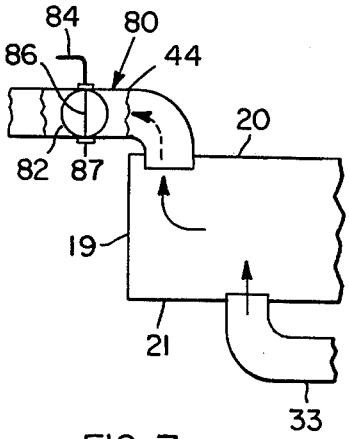
FIG. 7 is a diagrammatic representation showing a baffle arrangement according to another embodiment of the invention.

Another embodiment of the invention is shown with reference to FIGS. 7 and 8. With reference first to FIG. 7, discharge conduit 44 leads from top wall 20 of container 19 and conduit 33 leads to bottom wall 21 of the container as shown and described in substantial detail with reference to FIG. 1. An operator-operated baffle means designated by the numeral 80 is disposed within discharge conduit 44 and includes a plate 82 suitably secured to a baffle arm 84. Baffle plate 82 is arranged to be pivoted through baffle arm 84 about a baffle pin 86 which may be arranged in a sealed housing 87, and may be adjacent a resilient sealing washer or gasket such as 72 when closed and locked in position by a clamp such as 66 as heretofore described with reference to FIGS. 3, 4 and 5.

In FIG. 7, baffle plate 82 is shown in the open position; that is, air flows through conduit 33 and through the solution (not shown) in container 19 to thereby provide suds which are discharged through conduit 44 as heretofore described. When baffle plate 82 is actuated through arm 84 to a closed position, passage of suds is blocked. In this event air which would otherwise pass through conduit 33 backs up in the portion of the conduit not filled with liquid and backs up in conduit 43 shown in FIG. 8. As further shown in FIG. 8, conduits 42, 43 and 56 heretofore referred to with reference to FIGS. 1–6 are in direct communication with each other. The air flowing from conduit 42, and which backs up in conduit 43, passes through conduit 56 and into bag 54 to operate a valve means 88 as will next be described.

Bag 54 is secured by elastic means 90 around the upper periphery thereof to a cap 92 in communication with conduit 56. Cap 92 has an internal flange 94 extending around the periphery thereof. A diametrically disposed bar 98 is secured at its ends to flange 94 through bolts 99. Bar 98 has secured thereto a centrally disposed longitudinally extending bolt 100. Bolt 100 has at its upper end a head 102 disposed in a suitable recess in bar 98 and has at its lower end and threaded portion 104, and which threaded portion carrying a securing device such as, for example, an elastic stop nut 106 for purposes to be hereinafter described.

When baffle plate 82 is in the open position as shown in FIG. 7, a diaphragm member 108, which may be thin metallic disc centrally disposed relative to bolt 100 and displaceably disposed relative to bar 98, is biased by biasing means such as a helical spring 110 surrounding the portion of bolt 100 between fastening device 106 and diaphragm 108 so that the diaphragm rests against the bottom portion of flange 94 to seal bag 54 in accordance with the dotted representations in the figures.

When baffle plate 82 is closed so as to cause air to back up in conduit 43 and flow through conduit 56, the air pressure thereby generated exerts a downward force on diaphragm 108 as shown by the arrows in FIG. 8 to displace the diaphragm away from the flange against the force of spring 10, thereby unsealing the bag by creating a space along the sides of bag 54 whereby air flows into the bag as shown by the arrows to provide a suction or vacuuming effect. Upon the opening of baffle plate 82, the force of spring 110 forces diaphragm 108 against flange 94 to seal bag 54 as heretofore noted.

In this connection it is noted that even when baffle plate 82 is in the open position some air will flow through conduit 56. Diaphragm 108 may be unaffected by this flow of air and maintained in the position shown by the dotted lines in the figure by adjusting the tension of spring 110 through elastic stop nut 106 carried on threaded portion 104 of bolt 100 as will now be understood by those skilled in the art.

Bag 54 may be secured through elastic means 114 around its lower periphery to a removable lower cap 112. Cap 112 carries plug 55, and may be removed for adjustment of stop nut 106 to provide proper spring bias as particular conditions may require.

Thus, in the embodiment of the invention described with reference to FIGS. 7 and 8, baffle means 80 may be operator-operated to an open position whereby a sudsing or shampooing effect is provided and may be likewise operated to a closed position whereby valve means 88 is actuated by the air flowing into bag 54 to provide the aforenoted vacuuming or suction effect.

From the above description of the invention it will be seen that the improvement described herein provides cleaning apparatus which may be quickly and selectively conditioned for either the described shampoo cleaning or vacuum cleaning as may be desired. The conditioning for the several cleaning operations is accomplished without changing existing connections as has been heretofore required. The selective conditioning is controlled by the operator actuation of baffle means 40 or 80 and is thus accomplished quickly, simply and efficiently to enhance the cleaning operations.

Although several embodiments of the invention have been illustrated and described in detail it is to be expressly understood that the invention is not limited thereto. Various changes may also be made in the design and arrangement of the parts without departing from the spirit and scope of the invention as the same will now be understood by those skilled in the art.

What is claimed is:

1. In cleaning apparatus of the type including a main container having an inlet port open to the atmosphere, a second container supported within the main container and adapted to hold a detergent solution, a blower fan having an intake port communicating with the interior of the main container and a discharge port communicating through a first conduit to the interior of the second container and communicating through a second conduit to a bag means for collection contamination, the second container having a discharge conduit leading from the interior thereof and external to the main container, the improvement comprising:

baffle means arranged with the discharge conduit of the second container and including means selectively operator-operated to a first position for permitting air drawn into the main container through the inlet nozzle upon operation of the blower fan to flow through the first conduit to the second container for passage through the detergent solution therein to provide suds for delivery through the discharge conduit;

the baffle means selectively operator-operated to a second position for blocking delivery of suds through the discharge conduit of the second container, whereupon the air backs up in the first conduit and flows through the second conduit; and valve means supported within the collection bag means and closed when the air flows through the first conduit for sealing the bag means, and opened by the air flowing through the second conduit for unsealing the bag means whereupon said bag means receives the air flow.

2. Cleaning apparatus as described by claim 1, wherein the collection bag means includes a cap communicating with the second conduit:

a flange extends around the internal periphery of the cap;

the valve means includes a diaphragm and means for maintaining the diaphragm adjacent the flange for sealing the collection bag means when air flows through the first conduit; and the air flowing through the second conduit displaces the diaphragm away from the flange for opening the valve means and unsealing said bag means.

3. Cleaning apparatus as described by claim 2, wherein the means for maintaining the diaphragm adjacent the flange for sealing the bag means includes:

a diametrically disposed bar supported by the flange;

a longitudinally extending centrally disposed rod supported at one end by the and slidingly supporting said diaphragm bar; and biasing means surrounding the rod and biasing the diaphragm adjacent the flange for sealing the bag means when the air flows through the first conduit; said diaphragm being displaced against said bias upon the air flowing through the second conduit for unsealing said bag means.

4. Cleaning apparatus as described by claim 3, wherein:

the rod includes a threaded portion at the end thereof opposite the one end;

securing means being in threaded engagement with the threaded rod portion;

the biasing means being disposed between the securing means and the diaphragm; and the securing means being displaceable relative to the threaded rod portion for adjusting the bias of the biasing means.

5. Cleaning apparatus as described by claim 3, wherein:

the biasing means is a helical spring.

6. Cleaning apparatus as described by claim 2 wherein the collection bag means further includes:

a second cap; and a bag removably supported intermediate the first mentioned and second caps.

7. Cleaning apparatus as described by claim 6, wherein:

the second cap carries a removable contamination emptying plug.

8. Cleaning apparatus as described by claim 1, wherein:

the selectively operator-operated means included in the baffle means includes a plate and a handle mounted to the plate, said plate and handle being displaceably supported;

the handle being operator-displaced for displacing the plate to the first position, whereupon the discharge conduit is opened so that suds are delivered therethrough; and the handle being operator-displaced for displacing the plate to the second position, whereupon said plate closes the discharge conduit for blocking the flow of suds and for causing the air to back up in the first conduit.

9. Cleaning apparatus as described by claim 1, including:

suds application means connected to the discharge conduit of the second container for applying the suds delivered therethrough to an article being cleaned.

10. Cleaning apparatus as described by claim 1, including:

a suction element connected to the inlet port of the main container for sucking contamination from an article being cleaned when the vacuuming effect is provided.

* * * * *